US005330702A

United States Patent [19]

Kippenberg et al.

[11] Patent Number: 5,330,702

[45] Date of Patent: Jul. 19, 1994

[54] PROCESS FOR PRODUCING CUCR CONTACT PIECES FOR VACUUM SWITCHES AS WELL AS AN APPROPRIATE CONTACT PIECE

[75] Inventors: Horst Kippenberg, Herzogenaurach; Franz Hauner, Röthenbach, both of Fed. Rep. of Germany

[73] Assignee: Siemens Aktiengesellschaft, Munich, Fed. Rep. of Germany

[21] Appl. No.: 777,408

[22] PCT Filed: May 31, 1989

[86] PCT No.: PCT/DE89/00343

§ 371 Date: Dec. 2, 1991

§ 102(e) Date: Dec. 2, 1991

[87] PCT Pub. No.: WO90/15424

PCT Pub. Date: Dec. 13, 1990

[51] Int. Cl.[5] ..... B22F 3/24

[52] U.S. Cl. ..... 419/28; 419/47; 419/49; 419/54; 419/55; 419/58

[58] Field of Search ..... 419/10, 12, 13, 19, 419/23, 28, 47, 49, 54, 55, 58

[56] References Cited

U.S. PATENT DOCUMENTS

| | | | |
|---|---|---|---|
| 3,703,278 | 11/1972 | Isaksson | 266/24 |
| 4,067,379 | 1/1978 | Hässler et al. | 164/69 |
| 4,190,753 | 2/1980 | Gainer | 200/144 |
| 4,677,264 | 6/1987 | Okumura et al. | 200/144 |
| 4,836,978 | 6/1989 | Watanabe et al. | 419/10 |

FOREIGN PATENT DOCUMENTS

| | | |
|---|---|---|
| 0162801 | 11/1985 | European Pat. Off. . |
| 0184854 | 6/1986 | European Pat. Off. . |
| 0219231 | 4/1987 | European Pat. Off. . |
| 2521504 | 12/1975 | Fed. Rep. of Germany . |
| 2536153 | 1/1978 | Fed. Rep. of Germany . |
| 2914186 | 10/1979 | Fed. Rep. of Germany . |
| 3406535 | 9/1985 | Fed. Rep. of Germany . |
| 3543586 | 7/1986 | Fed. Rep. of Germany . |
| 3604861 | 8/1987 | Fed. Rep. of Germany . |
| 3729033 | 3/1988 | Fed. Rep. of Germany . |
| 2036654 | 12/1970 | France . |
| 58-37102 | 3/1983 | Japan . |
| 1459475 | 12/1976 | United Kingdom . |

*Primary Examiner*—Peter A. Nelson
*Attorney, Agent, or Firm*—Kenyon & Kenyon

[57] ABSTRACT

Purely powder-metallurgical processes or sinter-impregnation processes are often used to manufacture CuCr contact materials. Here the aim is to obtain the lowest possible residual porosity, which should be <1%. According to the invention, a powder moulding of the components is densified in two stages; the first stage is a sintering process with a densification of the sintered body to a closed porosity, and the second stage is a hot-isostatic pressing operation (HIP), in which the unencased workpieces are taken to a final density amounting to a space occupation of at least 99%. Thus, an economical method of manufacturing high grade material is obtained. It is possible to produce multi-layer contacts or self-adhesive bonds between the sintered body and a solid substrate, e.g. a copper contact bolt.

21 Claims, 1 Drawing Sheet

PROCESS FOR PRODUCING CUCR CONTACT PIECES FOR VACUUM SWITCHES AS WELL AS AN APPROPRIATE CONTACT PIECE

BACKGROUND OF THE INVENTION

The present invention relates to a process for producing a contact piece using copper and chromium for applications in vacuum-switch tubes, in which a powder blank is compacted from the starting components right down to a residual porosity of <1%, as well as to a contact piece produced in such a way.

Composite materials consisting of a conductive component and at least one high-melting component and, if necessary, also containing additives that lower welding force or reduce chopping current have proven their worth as contact materials for vacuum-switch tubes. The widely used CuCr materials are a typical example of this.

Since a high-melting component such as chromium only has a low solubility in the electrically conductive main component such as copper, powder-metallurgical processes are highly considered for manufacturing CuCr contact materials.

A process that is often applied to produce such contact materials is the sintering of a Cr skeleton and the subsequent infiltration of the sintered skeleton with Cu. This is described, for example, in the German patent applications DE-A-25 21 504 or the DE-B-25 36 153. The result in this case is that qualitatively high-grade materials with good switching properties can be obtained.

However, this process is susceptible to defects and requires considerable expenditure for quality assurance. Since a liquid phase is used, the blanks that are formed are clearly oversized and require machining to obtain the final form. Moreover, the requirement for a self-supporting skeleton means that the concentration range available to the high-melting component is restricted.

The last mentioned disadvantages can be avoided by using another widespread process, in which a powder mixture of the components is pressed or sintered and then still cold or hot afterpressed. This is described, for example, in the applications DE-A-29 14 186, the DE-A-34 06 535 and the EP-A-0 184 854. In this process, the concentration of the components can be selected within broad limits and the contour of the blanks can be set close to the final form, since extended cavity systems, such as those that can develop in poor impregnation materials, do not occur in the material. However, such materials have a residual porosity, usually between 4% and 8%, which has a disadvantageous effect on their application as a contact material for contact pieces of vacuum-switch tubes. The reason for this is that with increasing porosity, the danger of later breakdowns escalates and the breaking-capacity limit diminishes, whereby the welding tendency goes up.

From the EP-A-0 184 854, it is already known to compact the powder bodies not by means of solid-phase sintering, but rather by hot-pressing them. As a result, materials are produced which have a negligibly low residual porosity and which avoid the above-mentioned disadvantages. However, this manufacturing method must take place under a vacuum or in highly purified protective gas and is therefore cost intensive and thus relatively uneconomical.

DE-A-37 29 033 discloses another manufacturing method for CuCr contact materials, in which a solid-phase sintering step is combined with a hot-isostatic liquid-phase compressing step (HIP). One starts out from sintered bodies that have a relatively low compression ratio - whereby 80% of the theoretical density was already indicated as sufficient and these sintered bodies are isostatically hot-pressed at temperatures of about 200° C. above the melting point of the conductive component, copper. For this, the sintered bodies must be encapsulated under a vacuum to prevent air or gas from being occluded in the material pores and to prevent the chromium from being oxidized by the residual oxygen component in the pressure gas. Moreover, the encapsulation can prevent the internal armature of the pressing device from being contaminated by an overflowing liquid phase.

As is true of single-axial hot-pressing, negligibly low residual porosities are also produced with isostatic hot-pressing (HIP). However, the indicated HIP process is not economical for the industrial production of high numbers of pieces. Encapsulating the sintered bodies under a vacuum entails a cost-intensive production step; hot-pressing in the liquid phase, as indicated by the DE-A-37 29 033 as particularly advantageous, requires costly machining work to manufacture the contact facings.

Furthermore, the DE-A-35 43 586 mentions a hot-isostatic pressing of encapsulated blanks to produce contact materials on the basis of copper and chromium. However, this publication stresses that this process should not be regarded as a recommendable production process, but rather merely as a process for manufacturing reference specimen with few residual pores, that is only in special cases which justify such an expenditure.

It is also known from the general art of machine construction to manufacture parts with complicated contours using powder metallurgical means in process steps as disclosed in JP-A-58-37 102 (Patent Abstracts of Japan Vol 7, No. 120, Mar. 25, 1983). In this process powder is initially introduced into a flexible form under the pressure influence of a liquid. The molded components are subsequently sintered in a reductive atmosphere to a density of ≧93.5% and the sintered body is subjected to a hot-hydrostatic pressing operation, through which it obtains a density of ≧99%. This process has not previously been used to produce contact materials with copper and chromium since it was believed that it would entail a decisive reduction in quality. This was believed because of the high reactivity of chromium with oxygen since chromium oxides decisively worsen switching properties in a vacuum switch.

The present invention seeks to solve the problems of prior art processing methods. The present invention provides a process for producing CuCr contact pieces for vacuum switches of CuCr material, which provides an excellent material quality with a residual-pore component of <1% and which, at the same time, is inexpensive and economical when applied to the manufacturing of contact pieces from the material. In particular, this process should enable one to apply a molded-component technique with contours close to the final form and to dispense with costly measures, such as vacuum encapsulation.

According to the present invention a powder blank is compacted in two steps, whereby the first step is a sintering process with a compaction until a closed porosity of the sintered body, and the second step is a hot-isostatic pressing operation (HIP), in which the workpieces are brought unenclosed to a final density of at least 99% space filling.

A closed porosity is achieved with the CuCr material produced according to the invention with sufficient reliability as of about 95% space filling. For an HIP operation, the closed porosity is necessary for workpieces which are not encapsulated, to achieve the nearly complete compaction indicated according to the invention.

With the process according to the invention, a mixture of Cu powder and Cr powder can advantageously be pressed into a blank whose form already approaches to the greatest possible degree the geometry of the desired contact piece or of the required contact facing. In accordance with the indicated two-step process, this blank is sintered under a vacuum and/or under a reductive atmosphere in a solid Cu-phase and finally isostatically hot-pressed in a solid Cu-phase.

Contrary to the previous concept, it is crucial for this process sequence that the hot-isostatic pressing make do without encapsulating the CuCr workpieces. Experiments demonstrated in particular that, even without encapsulating the CuCr blanks during the process sequence according to the invention, additional gases are not occluded nor does the chromium oxidize inside the material. It was discovered that, due to the $O_2$ residual concentration in the pressure gas, the chromium only oxidizes on the surfaces of the workpieces. However, these outer surfaces are removed anyway when the contact pieces are finished. By sintering the blank under a vacuum or a reductive atmosphere, a reduction in the gas content is already achieved before the hot-pressing operation. However, this is not the case when encapsulated powder mixtures are hot-isostatically pressed or when blanks are cold-isostatically pressed and subsequently encapsulated.

Contact pieces produced with the process according to the invention have a high material quality due to the homogenous distribution of the components, their high compression and extremely low porosities. From this and from the compression and hardening of the material achieved by means of the hot-isostatic compression process, result the desired excellent contact properties, such as high breaking capacity, dielectric strength and resistance to erosion.

The cost-favorability of the process according to the present invention has to do, in particular, with the omission of the vacuum capsule and furthermore with the fact that by sintering and hot-pressing in a solid phase, the contour of the blank is able to be selected to be very close to the desired final form, so that only a minimal surface reworking is needed. It is thus equally ensured that the amount of utilized material is minimized.

The process according to the present invention can be advantageously realized by applying a combined sintering-HIP process, in which powder compacts of copper and chromium are initially sintered to low-porosity, in a vacuum or under $H_2$, and are subsequently isostatically hot-pressed in the same operation.

Composite parts can also be advantageously manufactured with the process according to the present invention: for example, contact facings of CuCr can be produced at the same time with the contact carriers of Cu, as two-layer or dual-area parts in one process sequence. One can consequently dispense with the bonding production step—usually the hard-soldering in the vacuum. This is an important advantage, particularly for the application of bases made of solid Cu, since these bases cannot be adequately bonded with the powder-metal compact by a sintering process alone.

DETAILED DESCRIPTION

EXAMPLE 1

Electrolytically produced Cr powder with a particle-size distribution of $<63$ μm is dry mixed with Cu powder of a particle-size distribution of $<40$ μm in the proportion 40:60 and pressed into rings of the dimension $\phi_a 60/\phi_i 35 \times 6$ mm, single-axially with an applied pressure of 800 MPa. The compacts are sintered at 1030° C. for 1 h under hydrogen with a saturation temperature of −70° C. and subsequently for 7 h under a high vacuum with a pressure $p < 10^{-4}$ mbar. The sintered bodies are subsequently hot-isostatically pressed at 950° C. for 3 h with 1200 bar under argon. The desired contact rings can be obtained simply by finish-turning the blanks.

EXAMPLE 2

Figure 1:
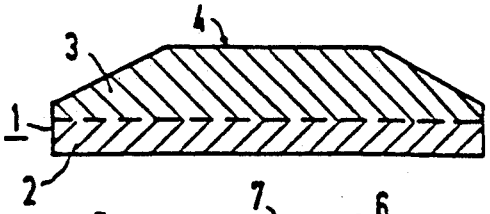
FIG. 1 illustrates a first contact piece in cross-section.

A powder mixture of 25 m % aluminothermically produced Cr powder with particle-size distributions of between 45 and 125 μm and 75 m % Cu powder with a particle-size distribution of $<40$ μm is pressed with a pressure of 600 MPa on to a base of Cu powder with a particle-size distribution of $<63$ μm. A two-layer compact 1 is formed according to FIG. 1 with a disk-shaped Cu layer 2 and a truncated-cone shaped CuCr overlay 3 with a contact surface 4. The compact 1 is sintered at 1050° C. for 6 h under a high vacuum at a pressure of $<10^{-4}$ mbar and subsequently hot-isostatically pressed at 980° C. and 1000 bar argon for about 3 h.

In a variant of this example, besides copper and chromium, the powder-metal compact can also contain high-melting components such as iron (Fe), titanium (Ti), zirconium (Zr), niobium (Nb), tantalum (Ta), molybdenum (Mo), or also alloys of these components. In addition, readily evaporative additives, such as selenium (Se), tellurium (Te), bismuth (Bi), antimony (Sb) or their compounds, can also be contained.

EXAMPLE 3

A powder mixture corresponding to Example 1 is pressed with a pressure of 600 MPa into disks and sintered under a high vacuum with a pressure of $<10^{-4}$ mbar at approximately 1060° C. already in the HIP device for about 4 h. Immediately after that, it is hot-isostatically pressed with 500 bar argon at 1030° C. for about 2 h.

EXAMPLE 4

Figure 2:
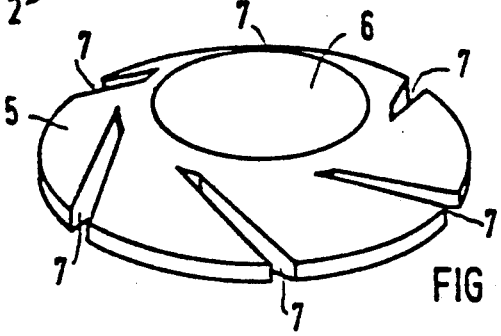
FIG. 2 illustrates a second contact piece in a perspective view.

A powder mixture of 60 m % Cu powder with particles sizes of $<63$ μm and 40 m % Cr powder with particle sizes of $<150$ μm is pressed with 750 MPa into truncated-cone shaped, contact disks 5, according to FIG. 2, with contact surfaces 6. At the same time, slot contours 7 are impressed during the pressing operation, perpendicularly to the pressing direction. The sintering and HIP processes are conducted as in Example 2.

As a variant, one can also use a layered structure with a CuCr powder mixture for the contact facing and a Cu powder layer to produce a base with excellent soldering capability, as described under Example 2.

EXAMPLE 5

Figure 3:
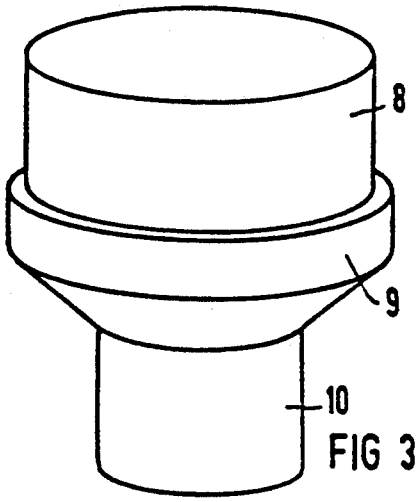
FIG. 3 illustrates a contact piece with a contact-piece base in a perspective view.

A powder mixture corresponding to Example 4 is pressed with 800 MPa into a flat, cylindrical contact facing 8 according to FIG. 3, and placed before the sintering process on a disk-shaped base 9 consisting of low-oxygen or oxygen-free (OFHC) copper. During the sintering process, which is carried out at 1060° C. for approx. 5 h, the compact 8 and the Cu-disk 9 bond together through sintering bridges. During a subsequent isostatic, hot-pressing step corresponding to Example 1, the compact 8 and the copper disk 9 bond so that the result is adequate compactness at the boundary layer. When the contact piece is used in normal operation, the copper base is able to be formed as a contact carrier or also directly as a current-supplying bolt 10.

In the described process for manufacturing contact pieces, the combination of the sintering and hot-pressing step is decisive for guaranteeing a high material quality. As a result of the closed porosity after the sintering process, there is no noticeable intercalation of air in the material during the HIP operation. This can be confirmed by measurements from the following table:

| | $O_2$/ppm | $N_2$/ppm |
|---|---|---|
| CuCr40, sintered state | 534 | 14 |
| CuCr40, hot-pressed state | 532 | 19 |

Thus, the oxygen and nitrogen contents lie in the same order of magnitude before and after the hot-isostatic pressing of the unenclosed workpieces.

Figure 4:
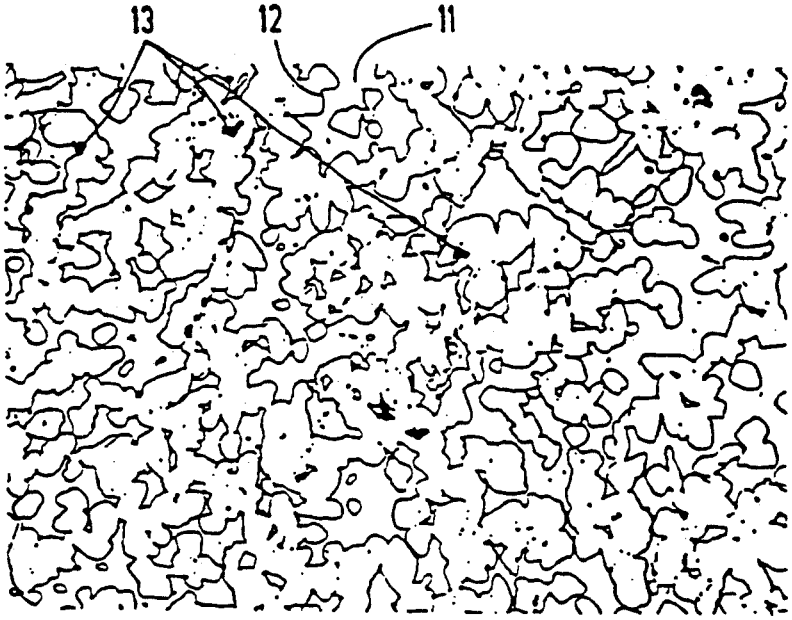
FIG. 4 and FIG. 5 illustrate structural patterns of the material, before and after the hot-isostatic pressing.
Figure 5:
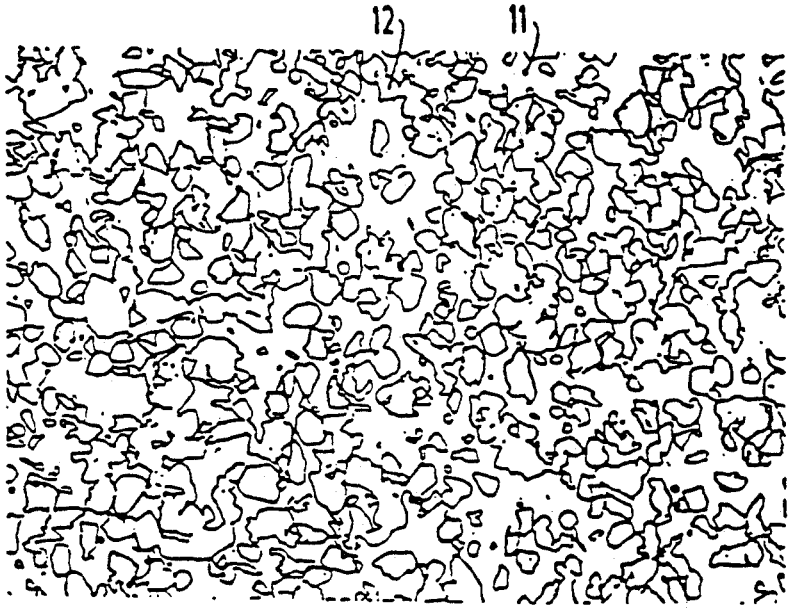

It becomes clear from the corresponding structural patterns that chromium particles 12 are embedded at any one time in a copper matrix 11, whereby in the sintered state in FIG. 4, blank spaces 13 still occur now and again. However, they are sealed to the outside due to the closed porosities. On the other hand, FIG. 5 confirms that by means of further isostatic compression, the blank spaces 13 in the CuCr material are completely eliminated. Consequently, a nearly compact material with a space filling of more than 99% now exists, and this material was manufactured in a comparatively simple manner.

We claim:

1. A process for producing a vacuum-switch contact piece with copper and chromium, in which a powder blank is compacted, comprises the steps of:

compacting the powder blank in two stages, in the first stage sintering to compact until a closed porosity of the sintered body is achieved; and in a second stage performing a hot-isostatic pressing operation for sintering the solid state of the copper-chromium compact, wherein the sintering process takes place at a temperature in the range of between 1000° C. and 1070° C. and the hot-isostatic pressing operation takes place under inert gas below the melting temperature of copper (1083° C.), and that the sintered body is brought unenclosed to a final density of at least 99% space filling.

2. The process according to claim 1, wherein the sintering process and the HIP process are carried out immediately one after the other, without any intermediate cooling, in a device for hot-isostatic pressing.

3. The process according to claim 1, wherein the sintering process is carried out in a high vacuum in the pressure range of $\leqq 10^{-4}$ mbar.

4. The process according to claim 2, wherein the sintering process is carried out in a high vacuum in the pressure range of $\leqq 10^{-4}$ mbar.

5. The process according to claim 1, wherein besides in a vacuum, the sintering is also carried out temporarily in pure hydrogen with a saturation temperature of $<-60°$ C.

6. The process according to claim 2, wherein besides in a vacuum, the sintering is also carried out temporarily in pure hydrogen with a saturation temperature of $<-60°$ C.

7. The process according to claim 1, wherein during the hot-isostatic pressing (HIP), the inert gas is argon or helium.

8. The process according to claim 2, wherein during the hot-isostatic pressing (HIP), the inert gas is argon or helium.

9. The process according to claim 8, wherein the hot-isostatic pressing (HIP) is carried out at pressures of between 200 bar and 2000 bar.

10. The process according to claim 7, wherein the hot-isostatic pressing (HIP) is carried out at pressures of between 200 bar and 2000 bar.

11. The process according to claim 1, wherein a powder compact consisting of a homogeneous mixture of copper and chromium with 25 to 40 m % Cr is used.

12. The process according to claim 1, wherein a powder compact is used, which in certain regions consists of a homogeneous mixture of copper and chromium with 25 to 40 m % Cr.

13. The process according to claim 12, wherein in addition to regions with CuCr mixtures, the powder compact also contains regions of pure Cu powder.

14. The process according to claim 1, wherein a powder compact is used, which in certain regions contains a powder mixture of copper (Cu), chromium (Cr), and one or more additional high-melting components such as iron (Fe), titanium (Ti), zirconium (Zr), niobium (Nb), tantalum (Ta), molybdenum (Mo), or alloys fo these components.

15. The process according to claim 12, wherein a powder compact is used, which in certain regions contains a powder mixture of copper (Cu), chromium (Cr), and one or more additional high-melting components such as iron (Fe), titanium (Ti), zirconium (Zr), niobium (Nb), tantalum (Ta), molybdenum (Mo), or alloys fo these components.

16. The process according t claim 8, wherein a powder compact is used, which in certain regions contains a powder mixture of copper, chromium, and other readily evaporative additives, such as selenium (Se), tellurium (Te), bismuth (Bi), antimony (Sb) or their compounds.

17. The process according to claim 12, wherein a powder compact is used, which in certain regions contains a powder mixture of copper, chromium, and other readily evaporative additives, such as selenium (Se), tellurium (Te), bismuth (Bi), antimony (Sb) or their compounds.

18. The process according to claim 1, wherein a powder compact is manufactured with a radially symmetrical geometry, for example, a ring, a disk, or a truncated cone, close to the final geometry of the finished contact piece.

19. The process according to claim 1, wherein a powder compact is manufactured with cutouts or slots parallel to the pressing direction.

20. The process according to claim 1, wherein the powder compact is sintered in the first stage on to a solid base and that, in the second stage, at the same time as the compaction toward end porosity, an intimate bonding between the sintered body and the solid base is produced.

21. The process according to claim 20, wherein a contact stud of low-oxygen or oxygen-free (OFHC) copper is used as a solid base.

* * * * *